US005170652A

United States Patent [19]

Fink et al.

[11] Patent Number: 5,170,652

[45] Date of Patent: Dec. 15, 1992

[54] PLANETARY ROLLING MILL

[75] Inventors: Peter Fink; Dieter Figge, both of Essen, Fed. Rep. of Germany

[73] Assignee: Mannesmann Aktiengesellschaft, Dusseldorf, Fed. Rep. of Germany

[21] Appl. No.: 785,867

[22] Filed: Oct. 29, 1991

[30] Foreign Application Priority Data

Nov. 2, 1990 [DE] Fed. Rep. of Germany ..... 4035275

[51] Int. Cl.[5] ..... B21B 13/20

[52] U.S. Cl. ..... 72/190; 72/241.4

[58] Field of Search ..... 72/163, 190, 191, 197, 72/241.2, 241.4

[56] References Cited

U.S. PATENT DOCUMENTS 2,975,663 3/1961 Platzer ..... 72/190

FOREIGN PATENT DOCUMENTS 66263 6/1976 Japan ..... 72/191

*Primary Examiner*—Lowell A. Larson

*Attorney, Agent, or Firm*—Cohen, Pontani, Lieberman, Pavane

[57] ABSTRACT

A roll stand for a planetary rolling mill includes two stationary opposed support bodies having an axis and forming a shaping zone there between; a plurality of intermediate rolls and a plurality of working rolls mounted for rotation around the support bodies and a rotatable member within at least one of these support bodies. The rotatable member has an axis of rotation parallel to the axis of the support body and is formed by a plurality of rolling segments each extending in a plane and having a curved geometry. Each rolling segment is made up of a plurality of spaced rolling surfaces extending in a direction of rolling for supporting the intermediate rolls within the shaping zone. The rotatable member is releasable mounted in three different planes within the support body.

8 Claims, 5 Drawing Sheets

PLANETARY ROLLING MILL

FIELD OF THE INVENTION

The present invention relates to a roll stand for a planetary mill and to a roll stand having interchangeable rolling segments for supporting the intermediate and work rolls. Specifically, the planetary rolling mill of the present invention includes chocks, arranged in a housing, for securing two stationary support bodies around which at set of intermediate rolls and working rolls mounted in cages rotate. The intermediate rolls are supported in the region of the shaping zone by rolling segments having rolling surfaces which are divided into a plurality of individual rolling surfaces disposed alongside of each other in a plane and between which rings, which are mounted on the intermediate rolls and center them, roll, and in which connection a plurality of rolling segments which can be brought into working position one after the other are associated with each support body.

BACKGROUND OF THE INVENTION

One rolling mill of this type, a so-called Platzer rolling mill, is described in U.S. Pat. No. 5,035,131 owned by common assignee Mannesmann A. G. U.S. Pat. No. 5,025,131 discloses four rolling segments distributed symmetrically over the circumference of the support body of the rolling mill. In that mill, the chocks, the support body and cages holding the two sets of intermediate and work rolls must be removed from the roll stand after the end of the useful life of a rolling segments has been reached, for instance, after about 25 hours. The assembly is turned 90° and reinstalled into the stand. This operation disadvantageously requires the shutting down of production.

There are instances, however of rolling mills of the above mentioned type in which the useful life of the rolling segments is less than 25 hours. Such cases occur, for instance, upon the rolling of alloy steels having high resistance to deformation, or else upon the rolling of structural steels at low rolling temperatures, in which connection high reshaping resistances also result. If the rolling forces are, for instance, twice as great in this case, this means a reduction of the useful life of the rolling segments by a factor of eight.

To transport the sets of rolls out of the stand after about three hours in order to change the rolling segments, means an unacceptable interruption of production of at least 30 to 40 minutes. Furthermore, there is the disadvantage that each set of rolls is of great weight and can be turned only with difficulty and by means of heavy devices. For the depositing of the individual sets of rolls, a free space is required and the handling of the set of rolls ties up a heavy crane.

The problems and disadvantages described above show that it may be more advantageous in certain applications if one could bring the different rolling segments into rolling action sequentially one after the other without removing the set or sets of rolls from the stand or without turning the chocks and support body. This would also lead to the advantage that rolling segments of different geometrical shape can be brought into action in a very short period of time. The present invention includes the above objects.

To achieve these and further objectives, the support body of the present invention comprises a plurality of rolling segments including associated rolling surfaces which are arranged on a turret head which can be mounted, such as, for example, by clamping in three planes and which is rotatable by motor around an axis parallel to the axis of the support body. The turret head is mounted on the support body within a recess thereof. The turret head permits the different rolling segments, and thus the rolling surfaces thereof to be brought into action one after the other by rotating the turret head around its longitudinal axis thereby enabling a very rapid change of the rolling segments without the necessity of removing the work and intermediate rolls.

The turret head is preferably composed of a cylindrical base member on which the rolling surfaces of the rolling segments are formed in spaced relation to each other on correspondingly shaped work pieces which are firmly attached to the base member. Between or alongside the work pieces support bearings having partially cylindrical slide surfaces are arranged, which, receiving the cylindrical regions of the base member, support and center the base member with respect to the support body. In this way, there is created a structural part for practicing the present invention in a particularly preferred manner. The described arrangement provides in addition to the rapid replacement of the rolling segments, a particularly dependable and stable support.

If, in accordance with another feature of the present invention, the rolling segments and their rolling surfaces are provided with different geometries, a particular advantage of the invention becomes evident. By simple turning of the turret head, it is possible to produce different profiles of the material being rolled by bringing rolling surfaces of different geometry into action for the supporting of the intermediate and working rolls.

To lock the turret head during the rolling operation, in accordance with another feature of the invention, the base member of the turrent head is clamped against the support bearings in a direction perpendicular to the rolling path and is locked against turning by means of clamping or wedge elements which engage or wedge against flattened circumferential regions of the cylindrical base member. In one particularly preferred embodiment the base member is member is hydraulically centered and secured to prevent movement thereof in the axial direction.

For the turning of the turret head through a specific angle, it is provided, in accordance with the present invention, that a swing drive be arranged or adapted for connection outside of the support body, said drive engaging via a pinion shaft with a gear wheel arranged on the cylindrical base member. For this purpose, there can be used a known swing drive with push-on gearing with which it is possible, by means of a toothed coupling, precisely to predetermine and effect an angular turning of the structural part to be swung. The angular movement corresponds to the position of the rolling surfaces of the rolling segments on the turret head.

The present invention enables, in simple fashion, either to replace worn rolling segments by turning the turret head or to adjust for different sections of rolled strip by turning to differently shaped rolling segments. While the simple turning of the turret head requires a less frequent removal of the rolling segments and thus considerably reduces the standstill times, the possibility of being able to choose the most suitably shaped rolling segment permits to influence the profile of the rolled material with very simple means.

BRIEF DESCRIPTION OF THE DRAWINGS

One embodiment of the present invention will be described below in more detail with reference to the drawings, in which.

DETAILED DESCRIPTION OF THE PRESENTLY PREFERRED EMBODIMENTS

Figure 1:
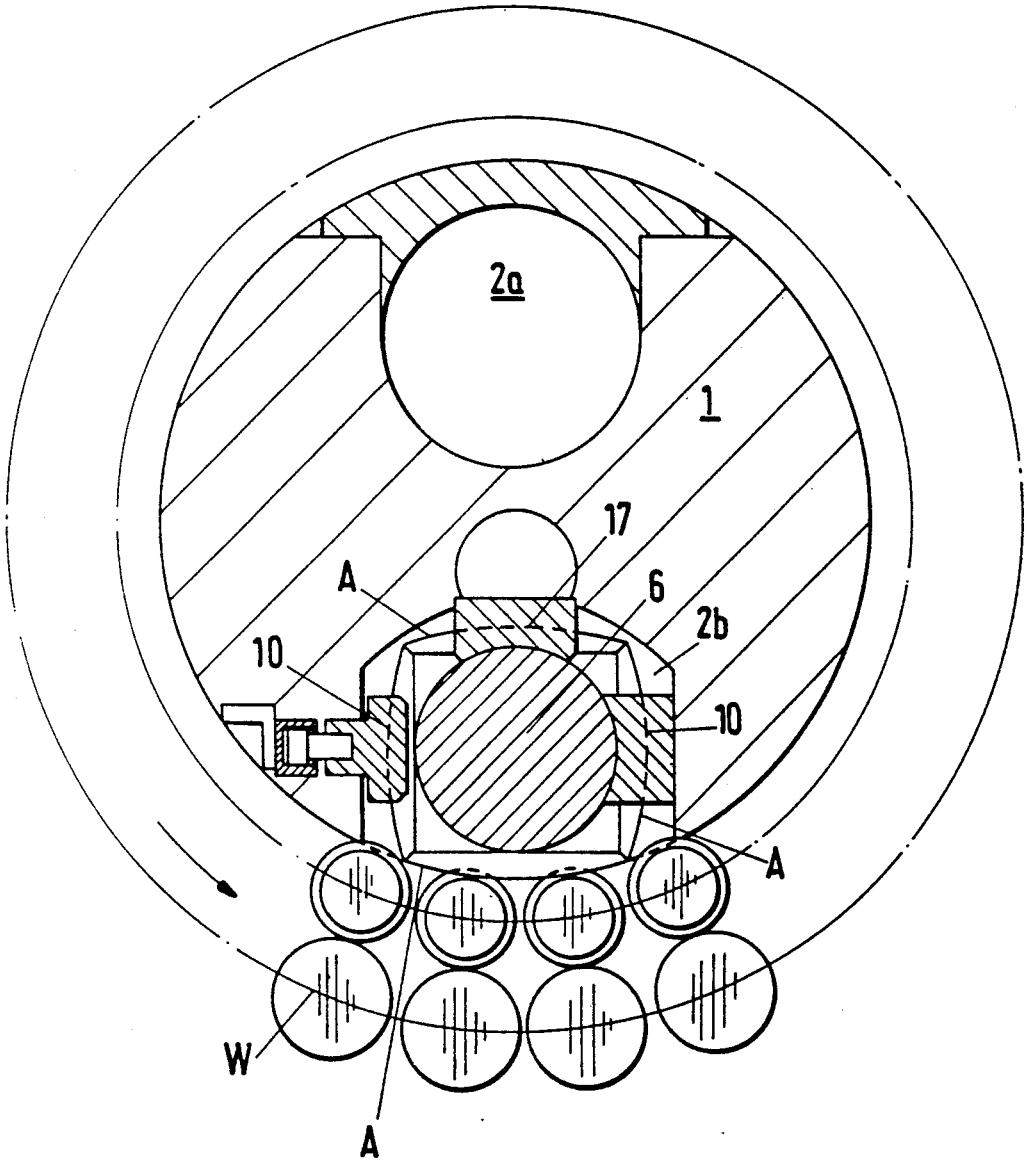
FIG. 1 is a cross sectional view through the support body of a roll stand of the present invention with turret head.

Referring to FIG. 1, 1 is the support body for the rotating work rolls W, it having on two opposite sides recesses *2a* and *2b*, one of which (*2a*) is intended to house part of the drive for the cages 5 and the other (*2b*) is adapted to house the turret head 6 of the present invention.

As will be described below, the turret head 6 is held in place and guided by support bearings 10, 17 which rest against corresponding bearing surfaces of the turret head.

Figure 2:
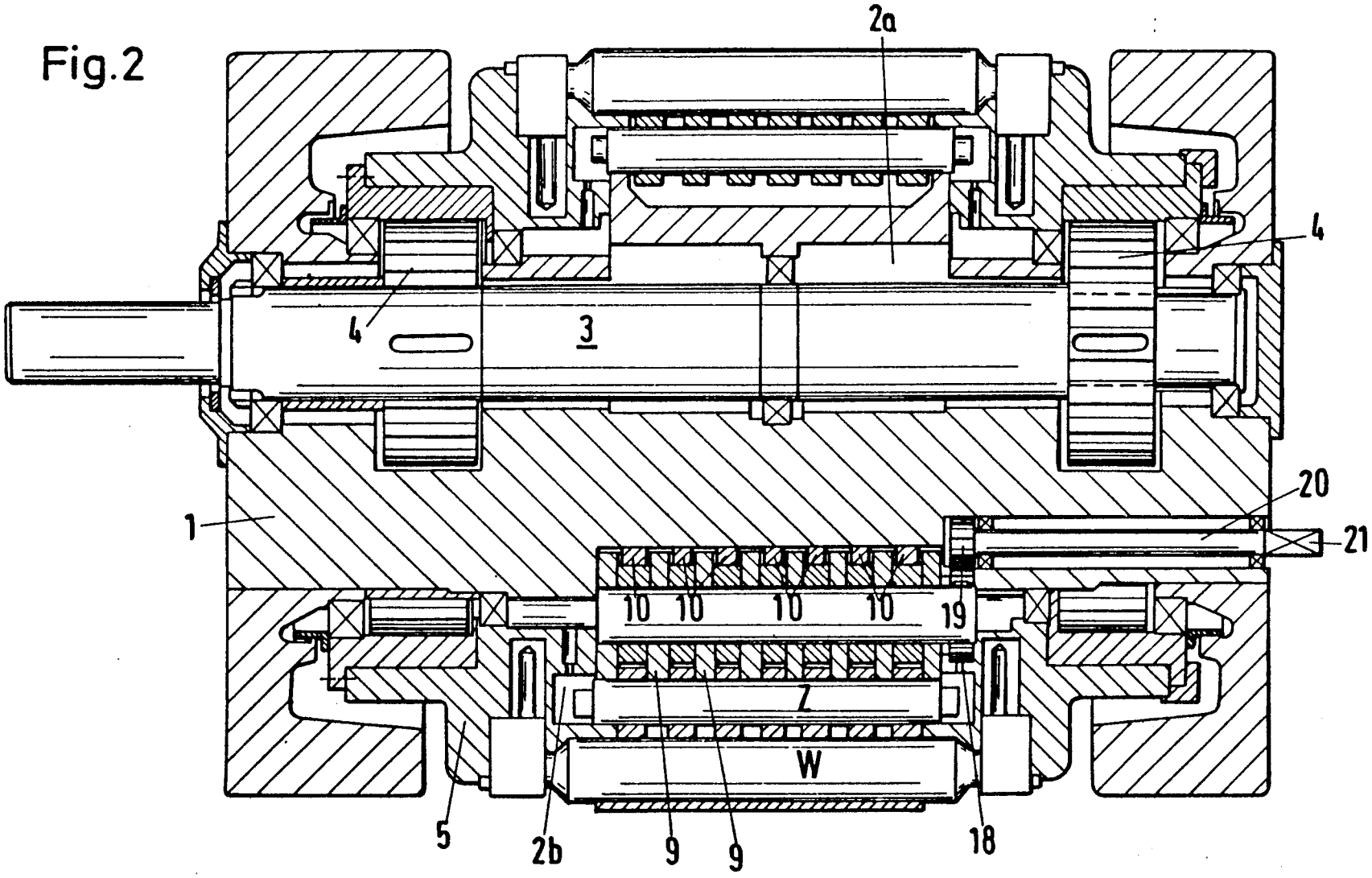
FIG. 2 is a longitudinal section through the support body with drive.

In FIG. 2, which is a longitudinal section through the support body 1, the position of the turret head 6 of the present invention can be noted. In the upper part of FIG. 2, there is a recess *2a* in the support body 1, which is occupied essentially by the main drive shaft 3 for the cage 5. By rotating the main drive shaft 3 and the gear wheels 4 which are arranged thereon, the cage 5 is placed in rotation together with the work rolls W. This drive is conventional and not part of the present invention, so that further details thereof are not necessary here.

In the lower region of FIG. 2, there can be noted, within the recess *2b*, the turret head 6 of the present invention which, via the rolling segments and particularly work pieces 9 and their associated rolling surfaces, supports the intermediate rolls Z and the work rolls W. Intermediated rolls Z are provided with surrounding rings 24 for centering the rolls.

Figure 3:
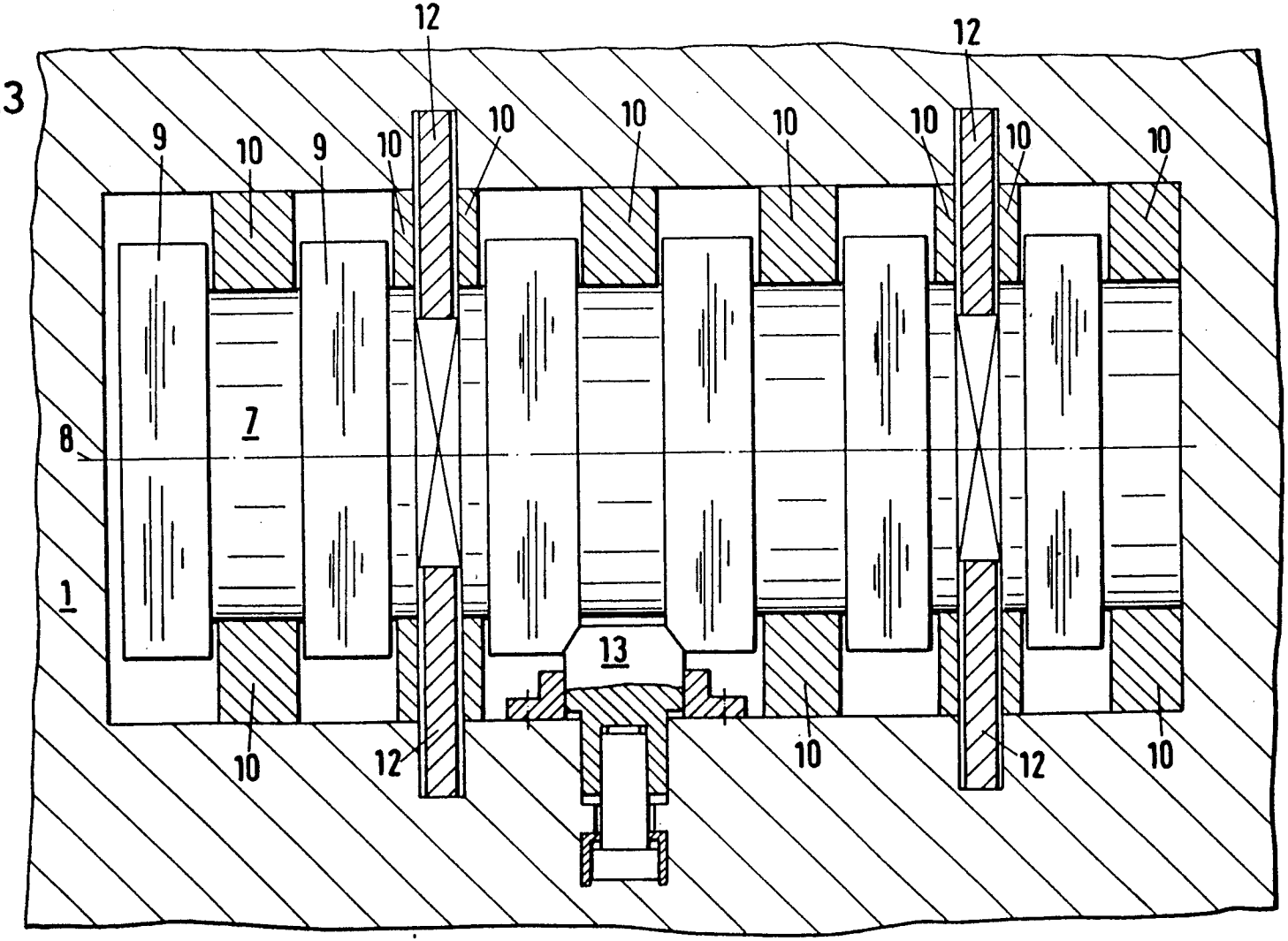
FIG. 3 is a view, partially in cross-section, of the turret head.

In FIG. 3, the turret head 6 is shown in diagrammatically simplified manner. The rolling segment includes the turret head which is composed of cylindrical base member 7 which can be turned in different angular positions around a longitudinal axis 8 which is parallel to the axis of the support body 1. On the cylindrical base member 1 work pieces 9 are arranged, and firmly connected with it. Work pieces 9 preferably form an integral part of cylindrical base member 1. The outer circumferential surfaces of the work pieces form the rolling surfaces of the rolling segments. The intermediate rolls Z roll on these rolling surfaces as indicated in FIG. 2 at 9.

Figure 5:
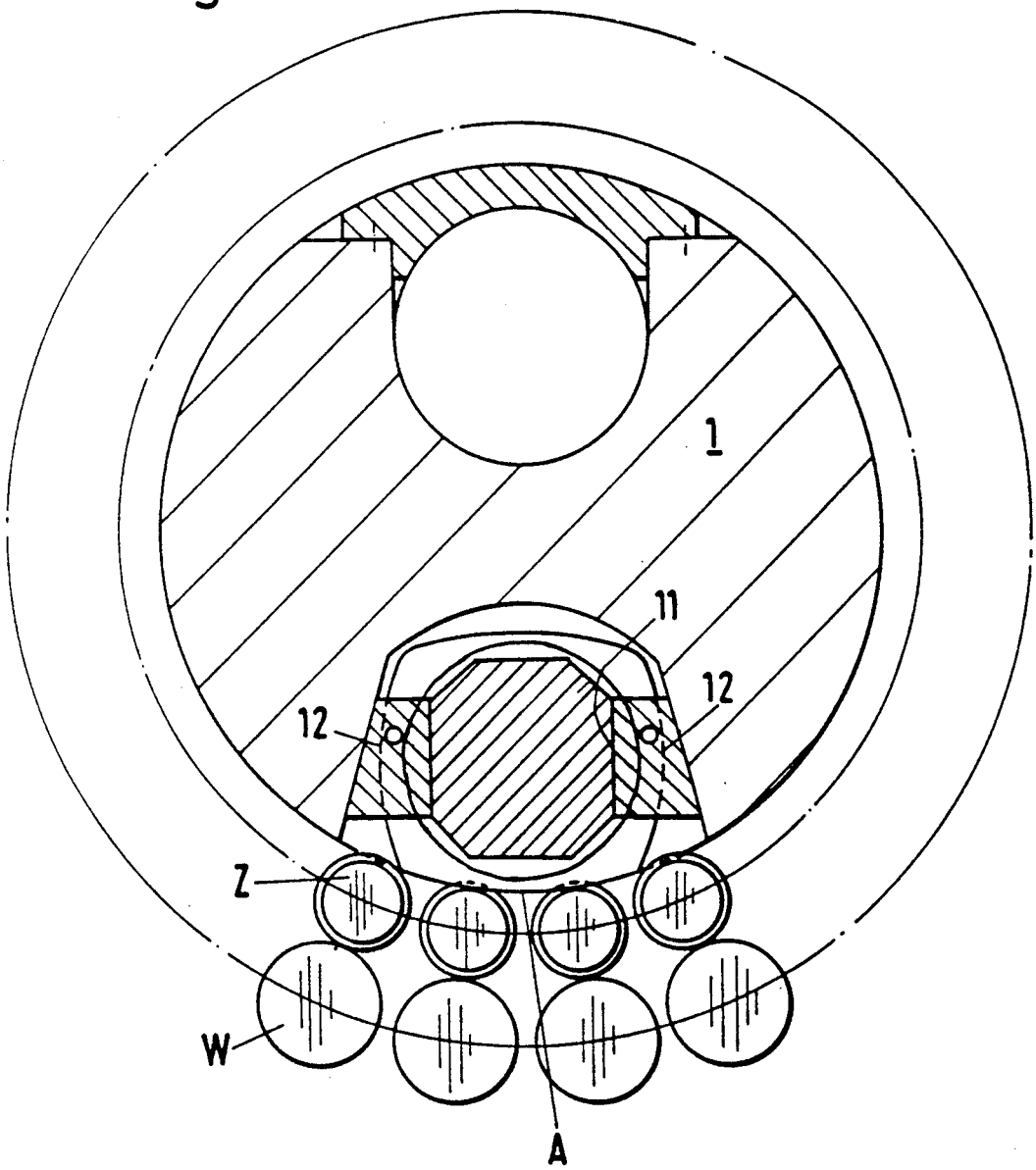
FIG. 5 shows the turret head clamping with wedge pieces, seen in horizontal direction.

Between the work pieces 9 of the rolling segments, there are arranged support bearings 10, which surround a part of the cylindrical base member 7 by suitably shaped slide surfaces thereby supporting it. Support bearings 10, in their turn, rest against the support body 1 of the roll stand. The cylindrical base member is provided with one or more flattened portions 11, which preferably have a square cross section (FIG. 5). Clamping or wedge pieces 12 which prevent a turning of the base member 7 are wedged against the flat region of the flattened section 11. These clamping pieces will be described also with reference to FIG. 5.

An axial centering and securing of the base member 7 is effected by a conical clamping or wedge piece 13 which inserted between two spaced work pieces 9 having correspondingly shaped conical abutting surfaces.

Figure 4:
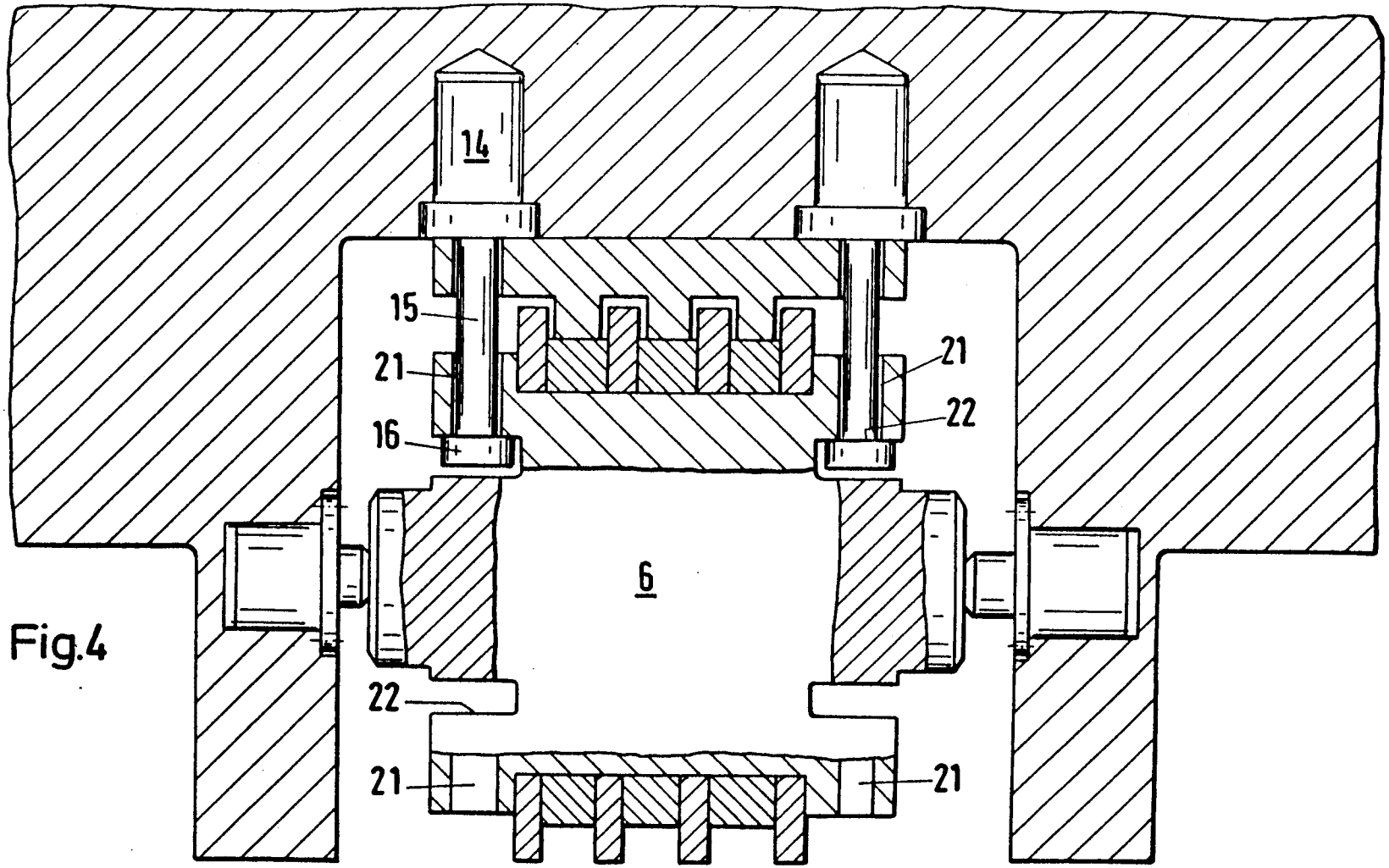
FIG. 4 shows the clamping of the turret head with swing tightener in vertical direction looking at the support body.

FIG. 4 shows how the turret head 6 is locked, preferably by clamping, in a plane perpendicular to the rolling surface which is in action. For this purpose, fastening means such as known swing tighteners are used, which include a piston-cylinder unit with a piston rod. At the free end of the piston rod, a clamping head is arranged which can both be turned about its axis via the piston-cylinder unit and also be moved in axial direction of the piston rod. In FIG. 4 such piston tighteners are designated 14, the piston rods 15, and the clamping heads 16. The piston rods 15 pass through holes 21 through which the clamping head 16 passes in one position of rotation of the piston rod 15. In the other position of rotation of the piston rod 15, the clamping heads 16 engage behind correspondingly shaped collars 22 on the turret head 6 so that, upon actuation of the piston-cylinder unit of the swing tighteners, the turret head 6 is pulled upwardly against the support bearing 17, which is shown in FIG. 1. To prevent movement of the turret head in axial direction the head is secured within support body 1 by hydraulic cylinders 23.

The securing of the turret head 6 against turning is shown diagrammatically in FIG. 5. As can be noted, the cylindrical base member 7 has, a substantially square flattened portion 11 against the side surfaces of which the clamping pieces 12 are wedged. The clamping pieces 12 are wedge-shaped for clamping the base member 7 against the support body 1. The actuating of the clamping pieces is effected by hydraulic cylinders (not shown) which act in vertical direction in known manner.

For a description of the turning of the turret head, reference is again had to FIG. 2. Here, it can be noted that the cylindrical base member 7 of the turret head 6 bears a gear wheel 18 into which a pinion 19 of a pinion shaft 20 engages. To the free end of the pinion shaft 20 there can be attached at 21 a swing drive (not shown) by which a moment of rotation for the precise angular turning of the turret head 6 can be applied from the outside, i.e. outside of the support body 1.

The manner of operation of the turret head is as follows:

For the turning of the turret head 6, the clamping elements 12 and 13 and the piston tighteners 14, which secure the base member 7 of the turret head 6 to the support body 1, are loosened first. By the action on the pinion shaft 20 of a torque from the swing drive attached to the shaft at 21, the turret head 6 is turned around its longitudinal axis 8 by a predetermined angular amount which corresponds to the position of the rolling surfaces which are respectively designated A in FIG. 1.

As soon as the turret head 6 is turned so that an adjacent or other rolling surface A is brought into the position which assures a rolling of the intermediate rolls Z during the rolling process, the clamping elements 12, 13 and 14 are actuated in clamping direction and the turret head 6 is securely mounted. This process can be carried out very rapidly, so that the down times of the rolling mill are reduced to a minimum.

Thus, while there have been shown and described and pointed out fundamental novel features of the invention as applied to preferred embodiments thereof, it will be understood that various omissions and substitutions and changes in the form and details of the disclosed invention may be made by those skilled in the art without departing from the spirit of the invention. It is the intention, however, therefore, to be limited only as indicated by the scope of the claims appended hereto.

What is claimed is:

1. A roll stand for a planetary rolling mill comprising:

two stationary opposed support bodies (1) having an axis and forming a shaping zone there between;

a plurality of intermediate rolls (Z) and a plurality of working rolls (W) mounted for rotation around said support bodies (1);

a rotatable member (6) within at least one of said support bodies, said rotatable member having an axis of rotation parallel to said axis of said support body and being formed by a plurality of rolling segments extending in a plane and having a curved geometry, each said rolling segments comprising a plurality of axially spaced rolling surfaces extending in said plane and in a direction of rolling; and means for releasably mounting said rotatable member in three planes within said support body.

2. The roll stand according to claim 1, wherein said rotatable member (6) comprises a cylindrical base member (7) extending along said axis of rotation;

a plurality of axially spaced workpieces (9) connected to said cylindrical base member (7) and forming said rolling surface; and a plurality of support bearings (10) disposed between said workpieces (9) and said support body (1) for supporting said rotatable member.

3. The roll stand according to claim 2, wherein said mounting means comprises flattened circumferential portions in said cylindrical base member (7) and means (12) wedged between said flattened portions and said support body (1) for releaseably clamping said base member (7) against said support bearings (10) in a direction perpendicular to said direction of rolling.

4. The roll stand according to claim 1, wherein said rolling segment and said associated rolling surfaces have a differently curved geometry.

5. The roll stand according to claim 1, wherein said mounting means comprises means (13) for releasably clamping and for centering said cylindrical base member (7) in the direction of said axis of rotation.

6. The roll stand according to claim 5, wherein said clamping and centering means comprises a hydraulically actuated wedge shaped element for releasable engagement with said rolling surfaces.

7. The roll stand according to claim 5, additionally comprising means for rotating said rotatable member (6) about said axis of rotation and for a predetermined angular path, said rotating means comprising a gear wheel (18) on said base member (7); a pinion meshing with said gear wheel; a shaft connected to said pinion and means outside said support body for rotating said shaft, said pinion, said gear wheel and said cylindrical base member.

8. The roll stand according to claim 1, wherein said support body is formed as a double T-section having a horizontal web axis and an upper and lower recess; said rotatable member (6) being arranged within said lower recess; and additionally comprising cages rotatable about said support body for mounting said intermediate rolls and said work rolls and means within said upper recess for rotating said cages.

* * * * *